US008561237B2

(12) United States Patent
Stratten et al.

(10) Patent No.: US 8,561,237 B2
(45) Date of Patent: Oct. 22, 2013

(54) WEIGHTED SHOE INSOLE AND METHOD FOR MAKING THE SAME

(75) Inventors: Ronald James Stratten, La Mesa, CA (US); Peter Daley, Steamboat Spring, CO (US); Chang Woo Nam, Busan (KR); Hemant Thakkar, Kulpsville, PA (US)

(73) Assignee: Stratten Performance Group, LLC, La Mesa, CA (US)

( * ) Notice: Subject to any disclaimer, the term of this patent is extended or adjusted under 35 U.S.C. 154(b) by 67 days.

(21) Appl. No.: 13/243,278

(22) Filed: Sep. 23, 2011

(65) Prior Publication Data

US 2012/0090198 A1 Apr. 19, 2012

Related U.S. Application Data

(63) Continuation of application No. PCT/US2010/028875, filed on Mar. 26, 2010.

(60) Provisional application No. 61/163,573, filed on Mar. 26, 2009.

(51) Int. Cl.
*A43D 11/00* (2006.01)
*A43B 13/38* (2006.01)

(52) U.S. Cl.
USPC ..... 12/142 R; 12/146 R; 36/132; 36/44

(58) Field of Classification Search
USPC ..... 12/146 S, 146 R, 142 R, 146 M; 36/43, 36/44, 132
See application file for complete search history.

(56) References Cited

U.S. PATENT DOCUMENTS

| | | | | | |
|---|---|---|---|---|---|
| 2,545,910 | A * | 3/1951 | Aprile | 36/132 |
| 2,920,008 | A * | 1/1960 | Frieder et al. | 428/102 |
| 3,333,352 | A * | 8/1967 | Livingston | 36/132 |
| 3,517,928 | A * | 6/1970 | Shanahan | 482/105 |
| 4,252,315 | A * | 2/1981 | Kimura | 482/105 |
| 4,709,921 | A * | 12/1987 | Valuikas et al. | 482/105 |
| 4,823,483 | A | 4/1989 | Chapnick | |
| 5,338,600 | A | 8/1994 | Fitchmun et al. | |
| 5,638,613 | A * | 6/1997 | Williams | 36/43 |
| 5,829,171 | A | 11/1998 | Weber et al. | |
| 6,341,434 | B1 * | 1/2002 | Yeh | 36/132 |
| 6,502,331 | B2 * | 1/2003 | Hines | 36/132 |
| 2004/0205984 | A1 | 10/2004 | Hardt | |
| 2008/0229612 | A1 | 9/2008 | Sommer et al. | |
| 2008/0301887 | A1 * | 12/2008 | Baier et al. | 12/146 B |

FOREIGN PATENT DOCUMENTS

| | | | |
|---|---|---|---|
| EP | 1 602 294 | A1 | 12/2005 |
| WO | WO 2007/049838 | A1 | 5/2007 |

OTHER PUBLICATIONS

IPRP; PCT/US2010/028875, Oct. 6, 2011.

* cited by examiner

*Primary Examiner* — Marie Patterson
(74) *Attorney, Agent, or Firm* — Bose McKinney & Evans LLP

(57) ABSTRACT

A weighted insole assembly, comprising a top thermoformable material layer, a bottom thermoformable material layer, and a weighted unit encapsulated between the top and bottom thermoformable material layers, the weighted unit including a heavy filler material and having a specific gravity between about 2.0 and about 4.0.

15 Claims, 13 Drawing Sheets

WEIGHTED SHOE INSOLE AND METHOD FOR MAKING THE SAME

RELATED APPLICATIONS

This application is a continuation of PCT/US2010/028875, filed Mar. 26, 2010; which claims priority to U.S. Patent Application Ser. No. 61/163,573 filed Mar. 26, 2009, the entire disclosure of both applications are incorporated by reference herein.

TECHNICAL FIELD OF THE DISCLOSURE

The present invention relates generally to insoles and methods for manufacturing the same, and more particularly to weighted insoles and methods of manufacturing the insoles from layers of varying flexibility.

BACKGROUND OF THE DISCLOSURE

Speed, endurance, quickness of reaction and explosive power are critical attributes sought by athletes of all levels who are engaged in a wide spectrum of sports and activities. During the past 75 years, athletes have enhanced their performance abilities through weight training and specific exercises that are designed to build strength by means of resistance applied to various parts of the body. Sports performance centers have joined thousands of strength and conditioning professionals and athletic coaches to meet the growing needs of individual athletes or teams that are trying to improve their strength, quickness, speed, cardiovascular endurance, jumping ability or overall explosive power. Most of their training is in weight rooms or on sports fields or courts, often with cumbersome weighted equipment strapped to their bodies or extremities. The physical actions and movements of athletes training under such conditions are far different from what is required in actual competition or performance by the athlete. For the most part, the athlete cannot safely duplicate actual competitive practice or performance utilizing these cumbersome training implements, and is thus not able to maximize his or her explosive power, quickness, speed, and endurance in the athlete's particular sport. This is a significant drawback to the effectiveness of training in athletics. What is needed, then, is a training tool that fills this void and provides a safe cost-effective means for the athlete, sports coach, or trainer seeking to improve his or her performance or that of his client.

SUMMARY OF THE INVENTION

The present invention overcomes or ameliorates at least one of the prior art disadvantages discussed above or provides a useful alternative thereto by providing a novel weighted insole and method for manufacturing the same.

In accordance with one aspect of the present invention, a weighted insole assembly is provided and comprises a top thermoformable material layer, a bottom thermoformable material layer, and a weighted unit encapsulated between the top and bottom thermoformable material layers. According to this aspect of the present invention, the weighted unit includes a heavy filler material and has a specific gravity between about 2.0 and about 4.0.

In accordance with yet another aspect of the present invention, a method for fabricating a weighted insole assembly is provided. The method comprises the steps of creating a cavity in a first thermoformable material layer, inserting a weighted unit in the cavity of the first thermoformable material layer, placing the thermoformable material layer and the weighted unit into a mold, introducing a second thermoformable material layer into the mold, encapsulating the weighted unit between the first thermoformable material layer and the second thermoformable material layer by heating the mold and applying pressure, removing a weighted insole assembly blocker from the mold, and cutting the weighted insole assembly blocker.

In accordance with still another aspect of the present invention, an insole assembly training kit is provided. In accordance with this embodiment, the kit includes a pair of weighted insoles, each weighted insole having a weighted unit with a heavy filler material, and a pair of non-weighted insoles, each non-weighted insole having at least one flexible layer.

Other aspects and advantages of this invention will become apparent from the following description taken in conjunction with the accompanying drawings which demonstrate, by way of illustration and example, certain embodiments of this invention. It should be understood herein that these drawings constitute a part of this specification and are intended to provide various illustrative aspects of the present invention, as well as to demonstrate several alternative objects and features thereof.

BRIEF DESCRIPTION OF THE DRAWINGS

The above-mentioned and other advantages of the present invention, and the manner of obtaining them, will become more apparent and the invention itself will be better understood by reference to the following description of the embodiments of the invention taken in conjunction with the accompanying drawings, wherein.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
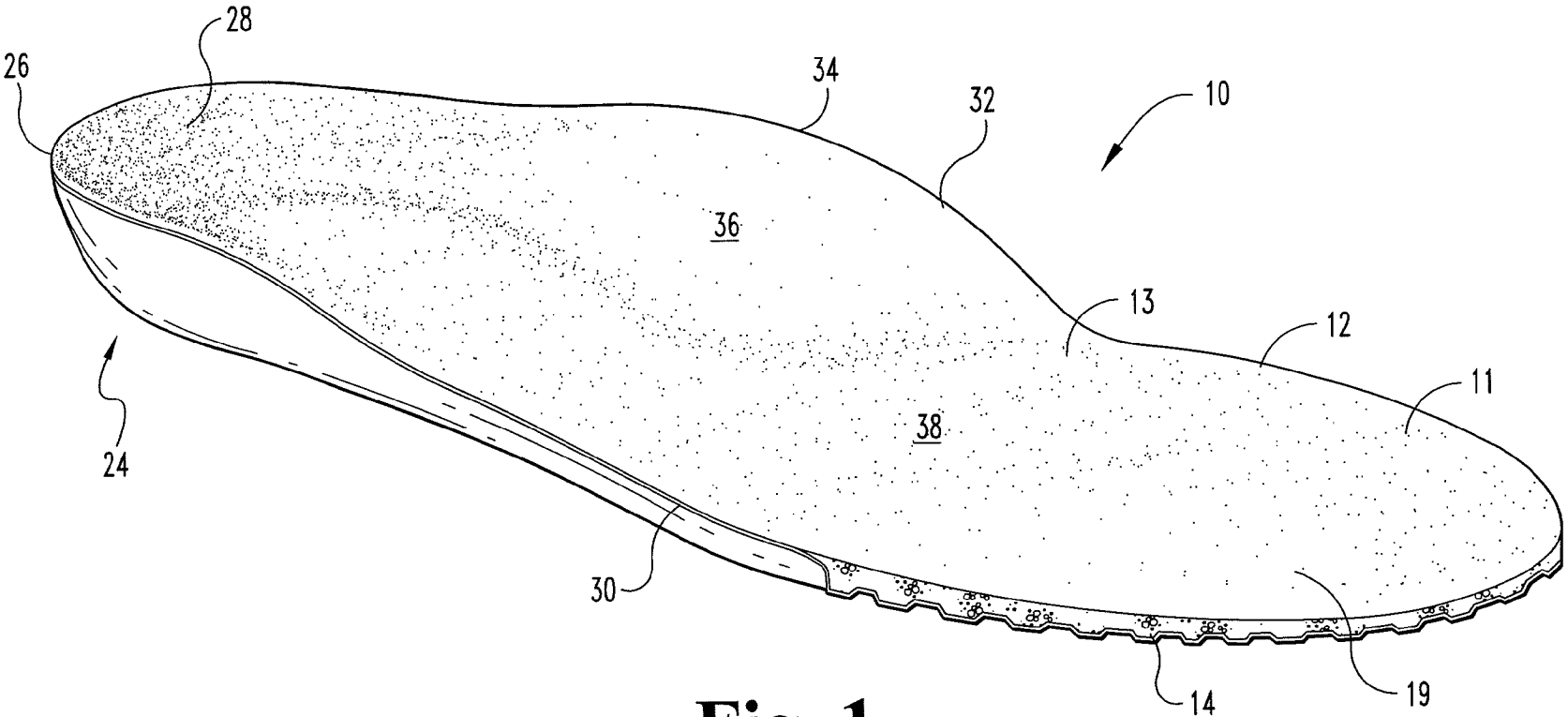
FIG. 1 is a perspective view of the weighted insole assembly in accordance with the teachings of the present invention.

Referring now to FIG. 1, a perspective view of a weighted insole assembly 10 in accordance with the teachings of the present invention is provided. As will be explained in greater detail below, the weighted insole assembly 10 includes layers of varying flexibility, which together cooperate to achieve a unitary insole with a contoured shape that is maintained once the assembly 10 is inserted into a user's shoe. As is seen in particular within the exploded perspective view of FIG. 2, the weighted insole assembly 10 comprises a top layer 12, a bottom layer 14 and a weighted unit 18 that is encapsulated between the top and bottom layers. A further understanding of how these layers conform to one another can also be appreciated by referencing FIG. 5, which illustrates a sectional view of the weighted insole assembly 10 cut along the longitudinal axis as shown in FIG. 3.

In certain aspects of the present invention, the top layer 12 may optionally comprise a fabric layer 15 that is adhered to its top surface 11. In accordance with certain embodiments, the fabric layer 15 of the top surface 11 may contain one or more materials to inhibit bacterial, microbial and/or fungal growth. The use of materials to inhibit bacterial, microbial and/or fungal growth within fibers and fabrics is well known, and includes the use of both organic and inorganic agents. Non-limiting and illustrative examples of some types of agents that may be used in accordance with the present teachings include, but are not limited to, antimicrobial polymerizable compositions containing an ethylenically unsaturated monomer, di-functional or tri-functional antimicrobial monomers and polymerization initiators, silver containing antimicrobial agents comprising carboxymethylcellulose, crosslinked compounds containing silver and/or silver salts of carboxymethylcellulose, organic solvent-soluble mucopolysaccharides consisting of ionic complexes of at least one mucopolysaccharide and a quaternary phosphonium, antibacterial antithrombogenic compositions comprising organic solvent-soluble mucopolysaccharides and organic polymeric materials, antibacterial antithrombogenic compositions comprising organic solvent-soluble mucopolysaccharides and inorganic antibacterial agents, and silver, copper, and/or zinc components incorporated into the fibers.

As is explained above, the use of a fabric layer 15 in conjunction with the top surface 11 is optional, particularly as such layer does not impact the associated performance attributes of the inventive insole assemblies. In accordance with certain embodiments of the present invention, however, it may be desirable to use a fabric layer to provide a comfortable contact surface for the foot of the user, as well as to provide an aesthetically pleasing covering for the insole assembly 10. Regarding the materials used to construct the optional fabric layer, it should be appreciated and understood that any known synthetic and/or non-synthetic fabric or fabric-like materials can be used in accordance with the present invention. Non-limiting and illustrative examples of various materials that can be used to manufacture the fabric layer include, but are not limited to, one or more of the following materials: merino wool, nylon, polyester, cotton, wool, rayon, acrylics, as well as any appropriate blends thereof.

To attach the optional fabric layer to the surface 11 of the top layer 12, any attachment means known within the art can be used. Such attachment means include, but are not limited to, welding, fusing, molding, gluing, adhering, threading, sewing, stitching and laminating.

Referring now to the top layer 12 and with specific reference to FIGS. 1 and 3, the top surface 11 is contoured to appropriately engage and cradle the plantar surface of a user's foot (not shown). To safely and effectively support the user's foot, the top surface 11 includes a relatively thin and substantially flat forefoot portion 19 that generally extends along a transverse or horizontal plane at the front end 22 of the insole assembly 10. The top surface 11 also includes a heel portion 24 at the rearward end 26 of the insole assembly 10 that is configured to partially cup the heel of the user's foot. To achieve this cupping result, the heel portion 24 of the insole assembly has a substantially concave section 28 that extends upwardly from the top surface 11 and creates a U-shaped perimeter that is configured to engage the back and side portions of a user's heel, thus providing necessary lateral stability. In addition to engaging the heel of a user's foot, the U-shaped concave section 28 of the heel portion 24 is shaped in an angled manner such that it is able to securely conform to the inside shape of the rear portion of a user's shoe. In other words, the concave section 28 joins the heel portion of the shoe to create a flush surface that will comfortably support and engage the user's foot during use.

As can be seen in FIG. 1, the concave section 28 of the heel portion 24 generally tapers downwardly in height along the lateral side 30 of the insole. The taper continues along the lateral side 30 of the insole assembly 10 until it terminates into the forefoot portion 19 of the top surface 11 around the instep 13 of the insole. While the concave section 28 of the heel portion 24 generally tapers downwardly from the rearward end 26 of the insole assembly 10 along its lateral side 30, the concave section 28 contrastingly tapers slightly upwardly in height along the medial side 32 of the insole. The upward taper reaches a maximum height 34 in an area that is substantially approximate to where a user's arch engages the insole assembly 10, and then generally tapers downwardly along the medial side 32 until it terminates into the forefoot portion 19 of the top surface 11 around the instep portion 13 of the insole. Special attention has been paid to providing arch and heel stability to the active athlete who depends on foot, ankle and knee stability and support.

Substantially adjacent to the area in which the medial side 32 achieves its maximum tapered height 34 is an arch support region 36 that slopes downwardly from the medial side 32 of the insole assembly 10 towards the lateral side 30 and along the area of the midfoot region 38. It should be understood and appreciated herein that the specific dimensions and angular configuration of the arch support region 36, as well as the entire insole itself, can be adjusted in accordance with the shape and size of the user's foot, as well as in accordance with the desired level of arch support to be achieved. In certain exemplary embodiments, the adaptive arch is so called because it is conforms to various shapes of users' feet, allowing more comfort and support in a weighted insole. In certain embodiments, it is possible to eliminate the arch support region 36 altogether and instead have a substantially flat area approximate the midfoot region 38. As such, the present invention is not intended to be limited herein.

The top layer 12 of the weighted insole assembly 10 can be fabricated from any thermoformable or thermoplastic foam or elastomeric material that provides some desired level of resilience and flexibility. In certain aspects of the present invention, the top layer 12 includes a polymeric material, such as, but not limited to thermoplastic synthetic resin foams such as ethylene-vinyl acetate copolymers (EVA) and cross-linked polyethylene (XLPE), thermosetting resin foams such as polyurethane (PU), or rubber material foams such as butadiene or chloroprene rubbers.

With respect to the hardness of the top layer 12 of the weighted insole assembly 10, the top layer generally has a durometer hardness of from about 30 Shore C to about 70 Shore C. As is generally known by those of skill in the art, hardness may be determined by the Shore (Durometer) test, which measures the resistance of a material (such as an elastomer) towards indentation. Shore hardness is typically categorized on a scale by using a durometer apparatus, which penetrates the sample material. The Shore C scale is used for "medium" rubbers. The durometer hardness and other properties of top layer 12 are selected so that the top layer provides a shock absorption system and dampens foot impact. This is particularly advantageous in a weighted insole used for training.

Figure 4:
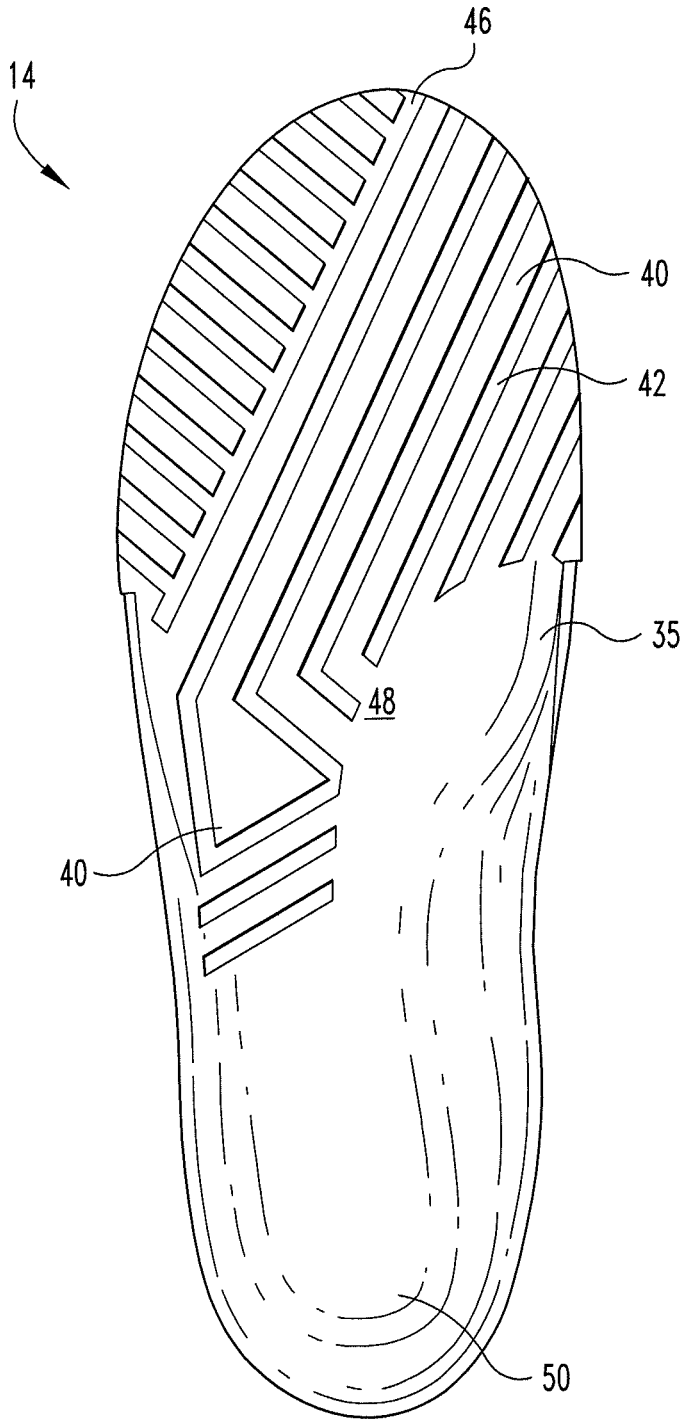
FIG. 4 is a bottom view of the weighted insole assembly in accordance with the teachings of the present invention.

Referring now to FIG. 4, the bottom side 35 of the insole's bottom layer 14 is shown. In accordance with certain aspects of the present invention, the bottom side 35 may contain one or more tread patterns 40 that are configured to frictionally interface with the top inside surface of a shoe once the insole is placed therein. The frictional impact of a tread pattern to a surface is clearly known within the art and is therefore not discussed in detail herein. Moreover, it should also be understood and appreciated herein that in other embodiments it may be desirable to create non-frictional interfaces between the bottom side 35 of the insole 10 and the top inside surface of the shoe. In accordance with these aspects of the invention, the tread pattern 40 may be eliminated altogether. In accordance with yet other embodiments, the treads 40 can span the entire bottom side 35 of the insole assembly 10 or on a portion of the surface. For instance, as is seen in FIG. 4, in accordance with this illustrative embodiment, the treads 40 are positioned within the substantially flat forefoot portion 42 which extends along the transverse or horizontal plane from the front end 46 of the insole assembly 10 to the midfoot region 48 and no tread pattern is provided in the heel portion 50 of the insole assembly. In alternative aspects of the invention the tread pattern may also be included in the heel portion 50 together with the forefront region, while in other aspects the tread portion may be solely contained within the heel portion 50 and is not included in the forefoot portion 42. As such, the present invention is not intended to be limited herein.

It should be understood and appreciated herein that in accordance with certain aspects of the present invention, it is desirable to formulate the weighted unit 18 so that it maintains some acceptable level of pliability and/or flexibility for the end user. However, as the amount of weighted filler within the weighted unit is increased to achieve a higher specific gravity based product, the more these desired flexibility and pliability characteristics are inhibited. To maintain an appropriate level of pliability and flexibility, however, the present inventors have found that it is particularly useful to add one or more tread patterns 40, and particularly tread patterns with lateral striations and angled grooves, to the bottom side 35 of the insole's bottom layer 14. By having such tread patterns 40 fabricated into the bottom side of the insole, the insole is allowed to maintain some flexibility as a result of the angled grooves, and as such, is able to reduce and minimize the inherent rigidness that is imparted on the weighted unit by its associated filler components.

The bottom layer 14 of the weighted insole assembly 10 can be fabricated from any rubber-like material that has both rigidity as well as some flexibility. In certain aspects of the present invention, the bottom layer includes a polymer with some elasticity, such as, but not limited to an elastomeric material selected from one or more of natural rubbers, synthetic polyisoprenes, butyl rubbers (e.g., copolymer of isobutylene and isoprene), halogenated butyl rubbers (e.g., chlorobutyl rubber and bromo-butyl rubber), polybutadienes, styrene-butadiene rubbers (e.g., copolymer of polystyrene and polybutadiene), nitrile rubbers (e.g., copolymer of polybutadiene and acrylonitrile), hydrogenated nitrile rubbers, chloroprene rubbers, polychloroprenes, neoprene, baypren, EPM (ethylene propylene rubber, a copolymer of ethylene and propylene) and EPDM rubber (ethylene propylene diene rubber, a terpolymer of ethylene, propylene and a diene-component), epichlorohydrin rubbers, polyacrylic rubbers, silicone rubbers, fluorosilicone Rubbers, fluoroelastomers, perfluoroelastomers, polyether block amides, chlorosulfonated polyethylenes and ethylene-vinyl acetate copolymers (EVA). Those skilled in the art will appreciate, however, that other flexibly rigid materials in addition to the above-described elastomeric materials may alternatively be used to fabricate the bottom layer 14 while still staying within the scope of the present invention.

In accordance with certain aspects of the invention, the hardness of the bottom layer 14 of the weighted insole assembly 10 has a durometer hardness of from about 60 Shore C to about 90 Shore C. In accordance with still other aspects of the present invention, the bottom layer 14 has a durometer hardness of from about 70 Shore C to about 80 Shore C. It should be understood or appreciated herein that the hardness of the bottom layer can be adjusted as necessary without straying from the teachings of the present invention; however, it is desirable that the bottom layer 14 have at least some stiffness or rigidity in order to hold the weighted unit 18 in place during use.

Figure 2:
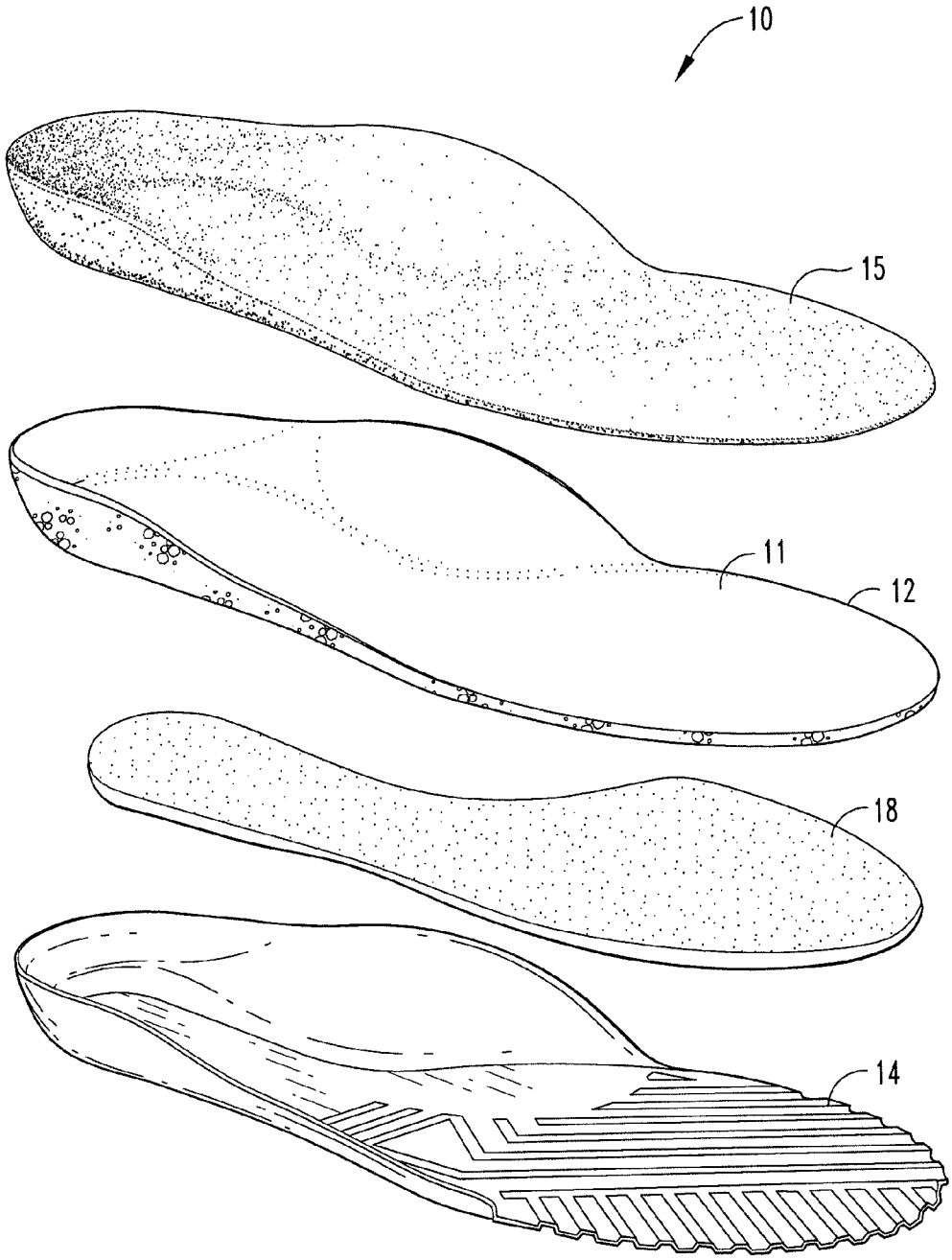
FIG. 2 is an exploded view of the weighted insole assembly in accordance with the teachings of the present invention.
Figure 3:
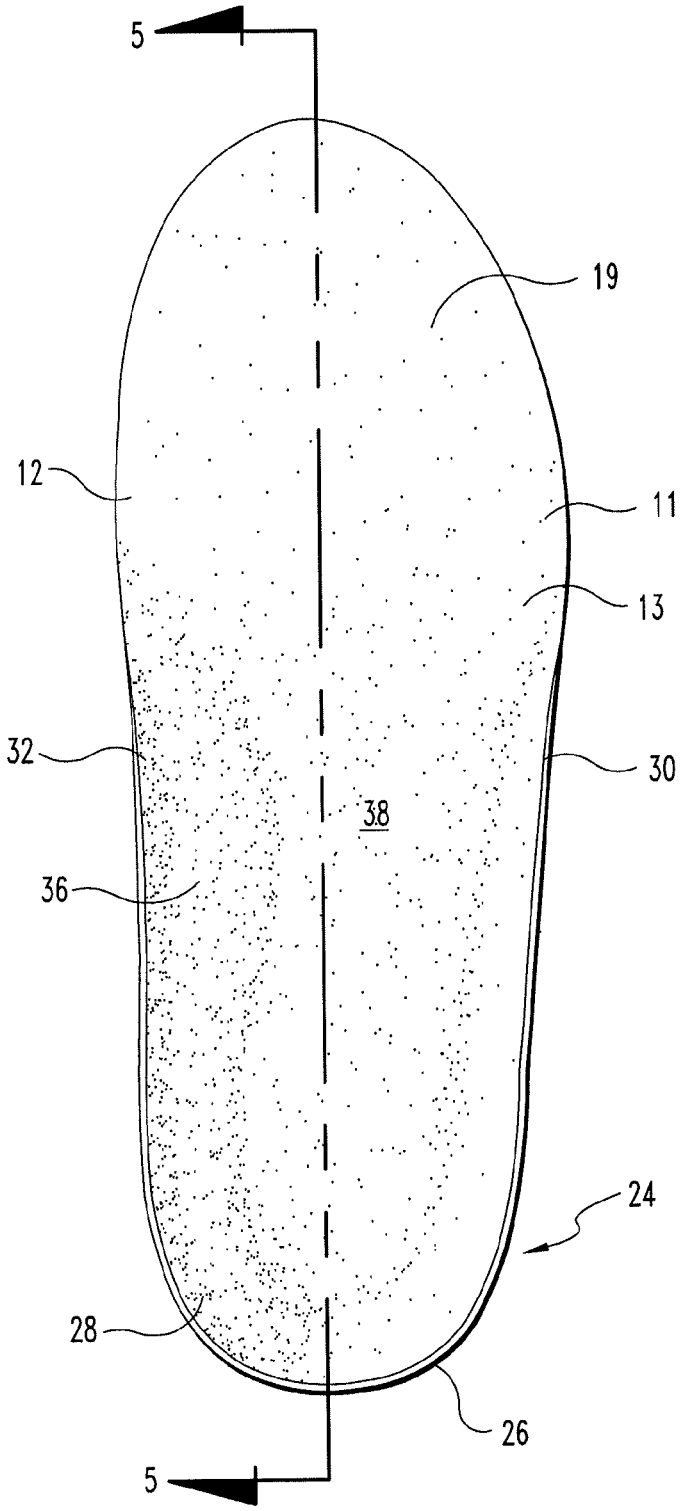
FIG. 3 is a top view of the weighted insole assembly in accordance with the teachings of the present invention.
Figure 5:
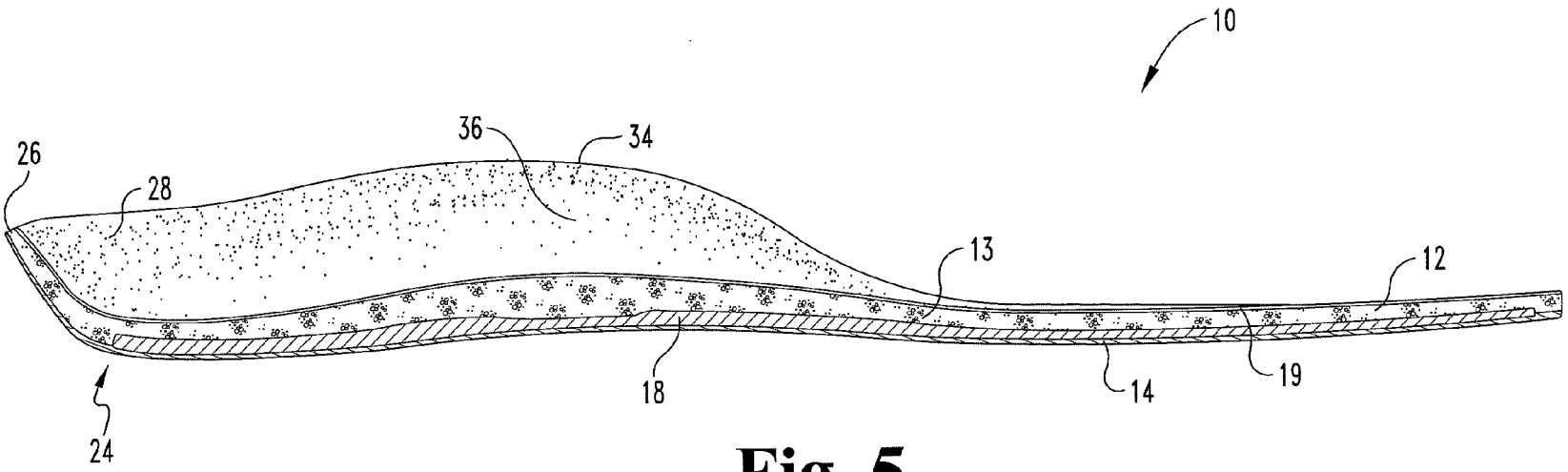
FIG. 5 is a sectional view of the weighted insole assembly cut along a longitudinal axis as indicated in FIG. 3 and in accordance with the teachings of the present invention.

As can be seen from FIGS. 2 and 5, encapsulated between the top layer 12 and the bottom layer 14 is a weighted unit 18. In accordance with certain aspects of the present invention, the weighted unit 18 is laminated directly to the bottom layer 14 of the insole assembly 10 by utilizing a primer to treat the surfaces for lamination, while in other aspects of the present invention a cavity is fabricated into the top surface of the bottom layer 14. In accordance with embodiments in which the weighted unit 18 is fitted within a cavity of the bottom layer's top surface, the cavity can be specifically shaped in such a manner that the weighted unit 18 is held within a desired position within the insole assembly 10, and particularly in such a manner that the weight of the unit is evenly distributed over the entire insole assembly.

In certain aspects of the present invention, the weighted unit 18 is a unitary piece and spans substantially the entire length of the top surface of the bottom layer 14. In other exemplary embodiments, the weighted unit 18 may span for only a portion of the top surface and/or may be separated into more than one piece—i.e., not as a unitary component. The specific size and distribution of the weighted unit 18 will depend upon the amount of weight desired to be added to the insole assembly. For instance, if the manufacturer wants the insole to have less weight, it is possible to fabricate a smaller amount of the unit into the bottom layer. Moreover, the desired weight to be incorporated into the insole can also depend on several factors including, but not limited to, the age, gender and/or size of the end user, as well as the specific athletic activity that will be performed by the end user upon wearing the insole.

In accordance with certain aspects of the present invention, the weighted unit 18, when in a fully cured state, has a durometer hardness of 6.5. In order to achieve the weighted properties desirable for the unit 18, the specific gravity is typically between about 2.0 and about 4.0. In other aspects of the present invention, the specific gravity is between about 2.5 and about 3.5, while in other aspects, the specific gravity is between about 2.7 and about 3.22. The specific gravity of the weighted unit 18 in accordance with the present invention has been found to create effective resistance without altering the length of the athlete's stride. It has been found that, by varying the formulation within the ranges disclosed herein, the weighted unit's specific gravity can be adjusted to produce lighter or heavier insoles that may be preferable for specific applications or for individuals of varying ages, sizes or athletic development.

In accordance with certain aspects of the present invention, the weighted unit 18 is fabricated with a heavy filler component. In accordance with certain embodiments, the filler component includes, but is not limited to, at least one compound selected from the oxides, carbonates, sulfides and hydroxides of metals of Groups I, II, IV, V and VIII in the Periodic Table and aluminum hydroxide. Embodiments of these compounds are metal oxides, such as copper oxide ($Cu_2$, CuO), zinc oxide (ZnO and activated ZnO), magnesium oxide (MgO), calcium oxide (CaO), lead oxide (O, $Pb_2O$, $Pb_2O_3$), tin oxide (SnO, $SnO_2$), antimony oxide ($Sb_2O_3$), iron oxide ($Fe_2O_3$, $Fe_3O_4$) and the like; metal carbonates, such as copper carbonate ($CuCO_3$), magnesium carbonate ($MgCO_3$), calcium carbonate ($CaCO_3$), barium carbonate ($BaCO_3$), zinc carbonate ($ZnCO_3$), cadmium carbonate ($CdCO_3$) and the like; metal sulfides, such as copper sulfide ($Cu_2S$, CuS), barium sulfide (BaS), zinc sulfide (ZnS), cadmium sulfide (CdS), iron sulfide (FeS, $Fe_2S_3$, FeS), cobalt sulfide (CoS, $CoS_2$, $Co_2S_3$, $Co_2S_7$, $CO_3S_4$, $Co_9S_8$), lead sulfide (PbS) and the like; metal hydroxides, such as copper hydroxide (Cu(OH), $Cu(OH)_2$), magnesium hydroxide ($Mg(OH)_2$), calcium hydroxide ($Ca(OH)_2$), barium hydroxide ($Ba(OH)_2$), aluminum hydroxide ($Al(OH)_3$), cobalt hydroxide ($Co(OH)_3$), lead hydroxide (Pb $(OH)_2$, $Pb(OH)_4$) and the like.

It should be understood and appreciated herein that the filler component used to fabricate the weighted unit in accordance with the present teachings is useful for increasing the compound's density, as well as to provide the necessary thinness, flexibility and suppleness for use as or in athletic shoe insoles without negatively impacting the shoe's performance.

In accordance with these aspects of the present invention, the insole is able to provide critical sport specificity or the ability to be worn with the full range of motion while engaged in any sport or athletic activity. While other filler materials can be used in accordance with the teachings of the present invention, the present inventors have found that zinc oxide is a particularly useful filler in accordance with certain aspects of the present invention. Moreover, it has been found that other ingredients are uniquely compatible with heavy fillers like zinc oxide.

Further advantages and improvements of the present invention are demonstrated in the following table which includes exemplary and illustrative ingredients and ranges that can be used to formulate the weighted unit in accordance with certain aspects of the present invention. This table is illustrative only and is being included to provide exemplary constituents that can be used to formulate the weighted unit in accordance with the present invention. This table, as well as the constituents provided herein are not intended to limit or preclude other variants, aspects, ingredients and/or constituents which may alternatively be used to formulate the weighted unit. As such, it should be appreciated and understood herein that the present invention is not intended to be limited.

TABLE 1

PRODUCT COMPOSITION AND PROPERTIES FOR WEIGHTED UNIT

| Material | Specific value (PHR—parts per hundred parts by weight of rubber) | Acceptable Range (PHR—parts per hundred parts by weight of rubber) | Specific Gravity | Volume |
|---|---|---|---|---|
| Royalene 552 | 100.00 | — | 0.86 | 116.28 |
| Stearic Acid | 1.50 | 1.00-3.00 | 0.84 | 1.79 |
| Zinc Oxide | 1250.00 | 400.00-1900.00 | 5.57 | 224.42 |
| Carbon Black N220 | 5.00 | 2.00-20.00 | 1.80 | 2.78 |
| Sunpar 2280 | 50.00 | 30.00-60.00 | 0.90 | 55.56 |
| TMTD | 1.00 | 0.8-1.2 | 1.42 | 0.70 |
| MBT | 0.50 | 0.3-0.7 | 1.51 | 0.33 |
| ZDMC | 0.80 | 0.6-1.0 | 1.71 | 0.47 |
| Sulfur | 1.00 | 0.8-1.2 | 2.07 | 0.48 |
| H300 | 40.00 | 20-70 | 1.00 | 40.00 |
| TOTAL | 1449.80 | — | 3.274157652 | 442.80 |

Fabricating the Weighted Unit

An illustrative example demonstrating the fabrication of the weighted unit using the above-referenced illustrative ingredients in the amounts provided is now discussed. In accordance with this exemplary illustration, the compound was mill mixed in small batches, yet it should be understood and appreciated herein that one of skill in the art would be able to significantly expand the process to accommodate larger production batches if desired. Moreover, specific molds that reflect a range of shoe sizes may also be preferred by the manufacturer.

First, the mill was heated at a temperature between about 150° F. and about 200° F. and the Royalene 552 banded by blending the mill between turning rollers, the turning rollers turning at slightly different ratios, such as a ratio of about 1-1.2. Next, the H300 is gradually added together with a small portion of zinc oxide together with steam on the mill rolls. As is generally known by those within the art, H300 is a polyisobutylene component that is available under the trademark Indopol H-300 and is available from Amoco and has a viscosity ranging from about 627 to 675 centistokes at 100° F. (ASTM D-445) and a number average molecular weight (as determined by vapor pressure osmometry) of about 1290.

The remainder of the zinc oxide is then added together with Sunpar and Stearic acid. Water having a temperature of from about 45° F. to about 70° F. is then added to the mill rolls, and then the curatives (i.e., TMTD, MBT, ZDMC and Sulfur) are added. It should be understood and appreciated herein that the amount of each material added will depend on the desired specific gravity of the product to be created. Using the acceptable amounts and ingredients shown above, those of skill in the art will be able to custom formulate a product with a certain specific gravity that is appropriate for the age, gender and/or size of an end user, as well as appropriate for the specific athletic activity that will be performed by the end user upon wearing the insole.

A run report of the mill provided by the Akron Rubber Development Laboratory indicated the following:

TABLE 2

| Molding Conditions |
|---|
| Cure Temperature = 350° F. |
| Cure Time = 30 minutes |
| Rheometer Data (ASTM D 2084) |
| Tech Pro MDR |
| 350° F., 3° arc, 30 min. chart speed, 30 inch lbs. (torque range) |
| Maximum Torque, MH, lbf-inch = 25.72 |
| Minimum Torque, ML, lbf-inch = 6.69 |
| Cure Time Tc50, minutes = 11.23 |
| Cure Time Tc90, minutes = 24.34 |
| Scorch Time, Ts1, minutes = 0.60 |
| Scorch Time, Ts2, minutes = 1.03 |

With reference to Table 2, it should be understood and appreciated herein that the curing temperatures move on a gradient of 18° F. As such, the higher the temperature, the shorter the curing time. Contrastingly, the lower the temperature, the slower the curing time. By way of example, and without intending to limit the teachings of the present invention, a curing time of approximately 368° F. would equate to approximately 15 of curing time, while a curing time of approximately 332° F. would equate to approximately 45 of curing time.

The compound was then mixed and poured onto a calendaring machine which flattened the mix into the prescribed width and tolerance.

It should be understood and appreciated herein that all rubber compound recipes are being provided on the basis of 100 parts of rubber (Royalene 552 in this exemplary illustration) and the other ingredients are being listed as PHR or phr, meaning parts per hundred of rubber. Based on this approach, Royalene 552 will always be 100 parts in the recipe, and Indopol H300 can be varied between 30-70 phr or even higher. In accordance with certain aspects of the invention, the Indopol H300 is present in the amount of at least 40 phr, particularly as the present inventors have found that amounts below this level may make the flexibility of the product insufficient for certain applications. It should be understood and appreciated herein that increasing the level of Indopol H300 generally increases the product's flexibility, yet lowers the specific gravity of the compound. By weight percent, Royalene 552 is about 6.92% and Indopol H300 is about 2.77%, in accordance with certain exemplary compositions, although these amounts may be varied, as noted above.

Certain additives may also be added to the composition during its formulation. For example, a pigment such as iron oxide in an amount of about 0.5-10 parts by weight of total rubber (phr) imparts a red color to the finished product.

It may also be desirable to add a microbial agent such as Ottacide-P (Borate ester of parachlorometaxylenol (PCMX)); Zinc Omadine (aka Zinc Pyrithione, ZnP or Pyrithione Zinc) or Micro-chek 11 P (2-n-octyl-4-isothiazolin-3-one) to the weighted unit and/or any of the other components of the inventive insole assemblies. If employed, the antimicrobial agents are generally present at low levels, for instance from about 0.1% to about 5% by weight based on the total weight of the compound. In still other illustrative embodiments, the antimicrobial agents are present from about 0.2% to about 2% by weight. Since the inventive compound in accordance with some embodiments may contain a high amount of the filler material (e.g., zinc), the amount of organic material is low. Consequently, it is envisioned that lower loadings of antimicrobial agents would perform acceptably.

Odor in rubber products can come both from certain ingredients as well as from degradation caused by microbes. For the latter, the addition of antimicrobial agents (as noted above) provides at least a partial solution. Regarding other deodorizing materials, the addition of certain porous fillers (diatomaceous earth) that will act as odor absorbers/absorbers may help. These may need to be added at 5-20 phr levels. The specific deodorizing agent, if any, to be employed depends upon the nature of odor causing materials. It is also possible, if desired to mask unacceptable odors by the use of "odor masking" materials, e.g., vanilla extract. While sodium bicarbonate (baking soda) is sometimes used as deodorizer, it is generally unsuitable with the compound of the present invention because it will decompose during mixing and curing and may undesirably cause porosity in the end product. The zinc oxide powder present in the disclosed compound should also help in absorbing certain odorous species.

Figure 6:
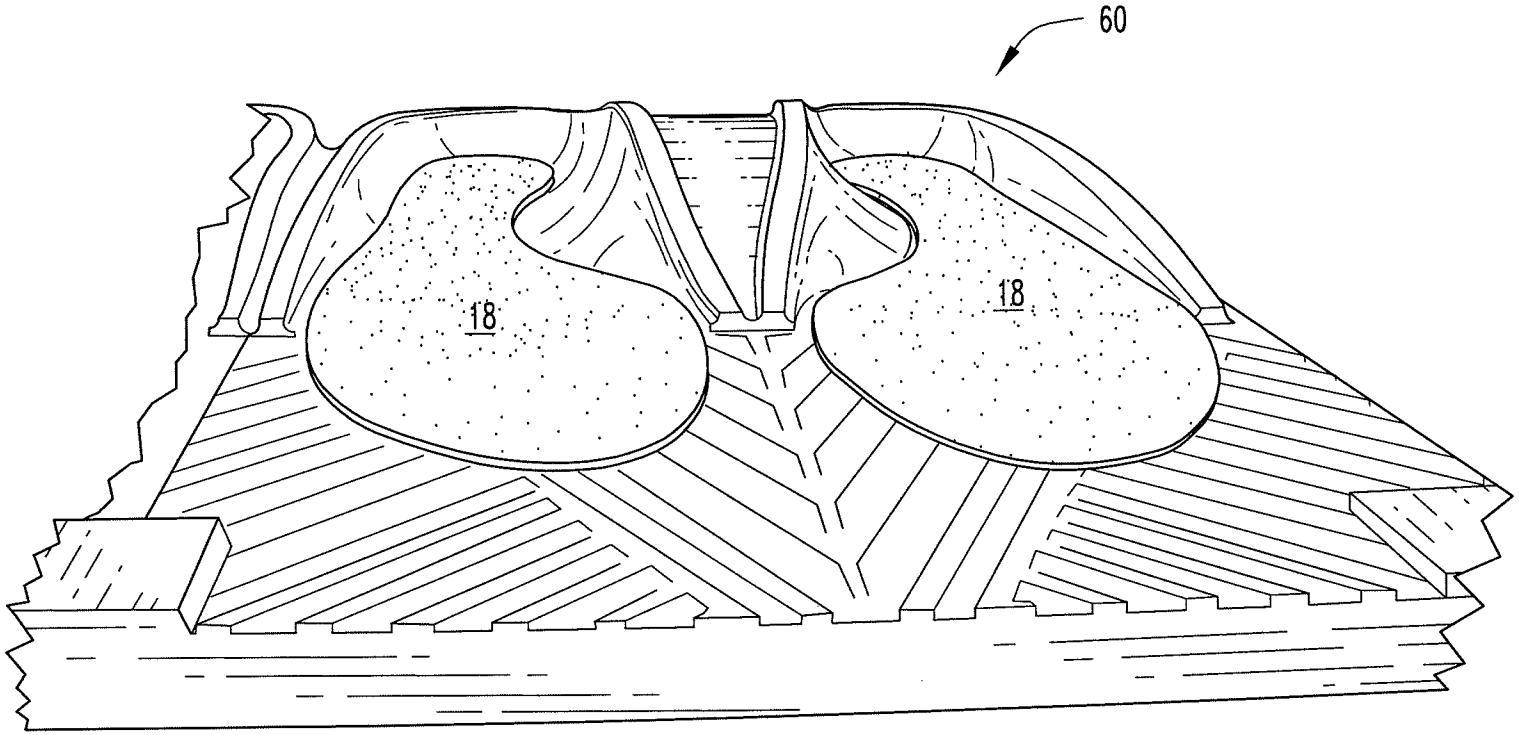
FIG. 6 is a fragmentary perspective view illustrating a weighted unit inserted into a mold in accordance with teachings of the present invention.
Figure 7:
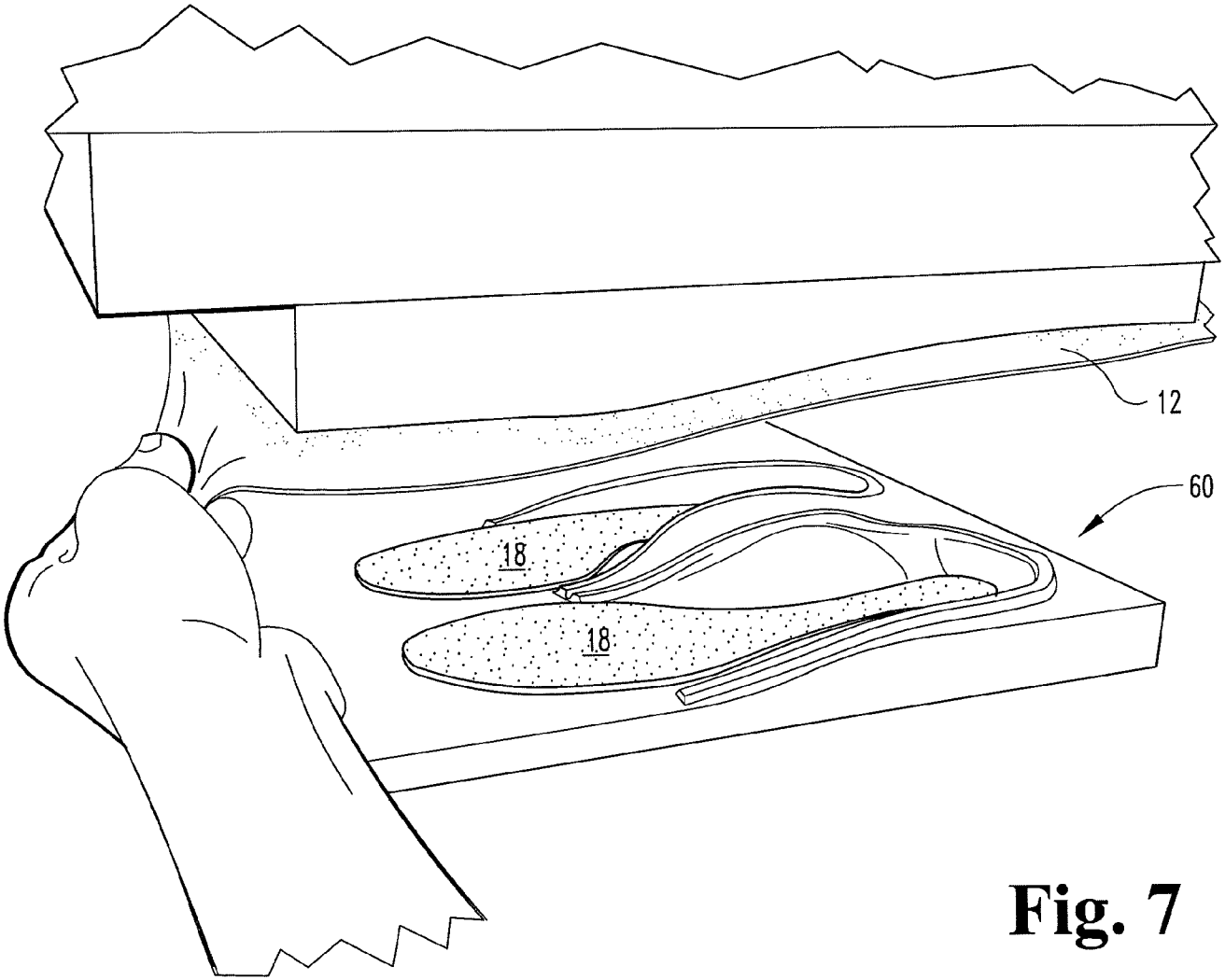
FIG. 7 is a fragmentary perspective view illustrating a thermoformable material layer added to the mold of FIG. 6.
Figure 8:
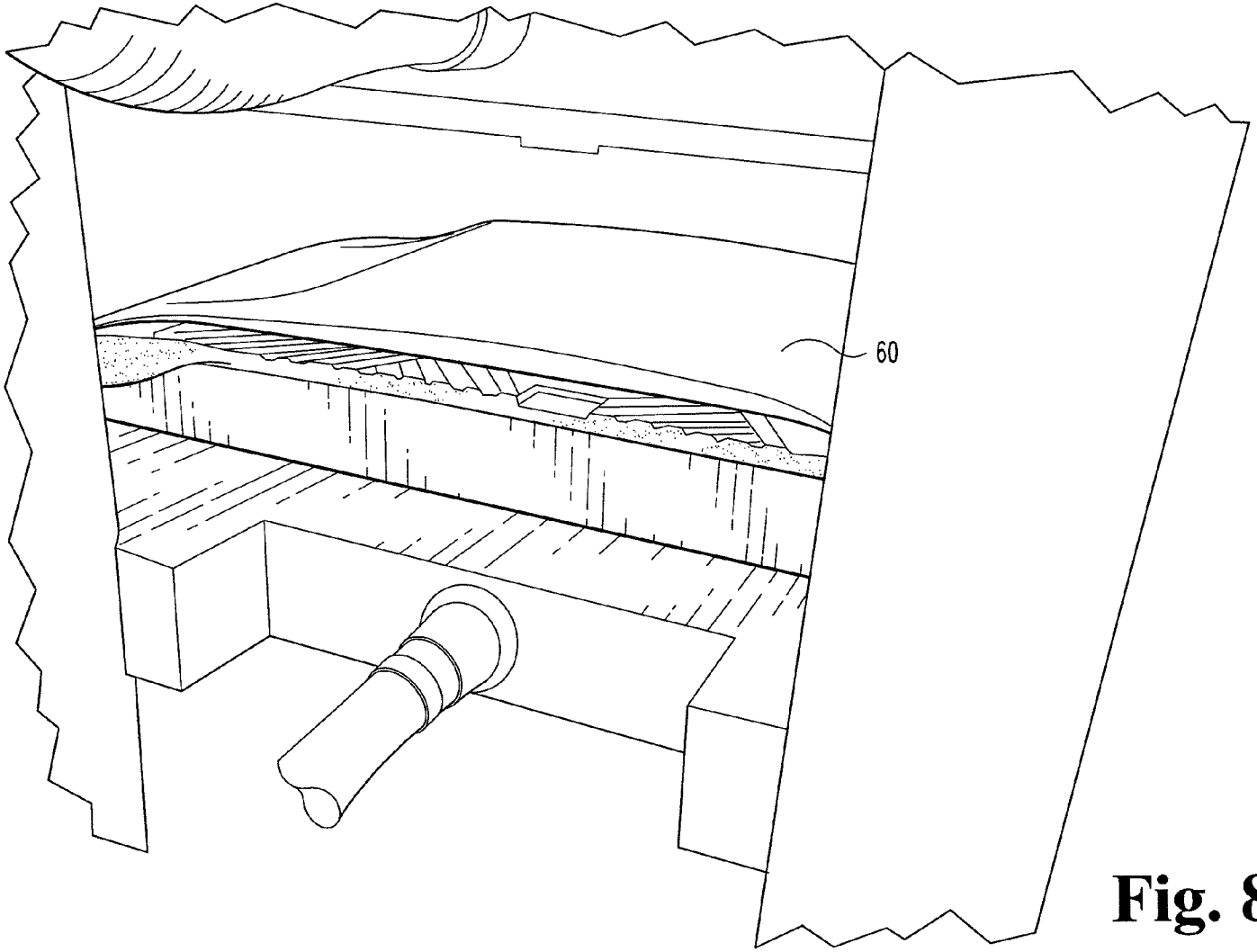
FIG. 8 is a fragmentary perspective view illustrating the weighted unit of FIG. 6 undergoing a molding process with the thermoformable material layer of FIG. 7.

Referring now to FIGS. 6-13, an exemplary method for manufacturing the weighted insole assemblies 10 of the present invention is now provided. As explained above, in certain aspects of the present invention, the weighted unit 18 may be laminated directly into the base (bottom) layer 14 of the insole utilizing a primer to treat the surfaces for lamination. In accordance with other embodiments, and with specific reference to FIG. 6-13, a cavity is created on the bottom surface of the top layer 12 to help hold the weighted unit 18 in a specific location during the molding process. In accordance with this exemplary embodiment, the weighted unit 18 is first placed in a mold 60 that is specifically shaped to accommodate the weighted unit (FIG. 6).

Once the weighted unit 18 has been securably positioned within the mold 60, the thermoformable top layer 12 is added to the mold (FIG. 7) and the mold is closed (FIG. 8) to begin the heat molding process. Processes for heat molding rubber components are widely known within the art and are thereby not discussed in great detail herein. It should be understood and appreciated, however, that the various listed components and ingredients, as well as their specific acceptable amounts as indicated above, should be used to create the weighted insole assemblies of the present invention.

Figure 9:
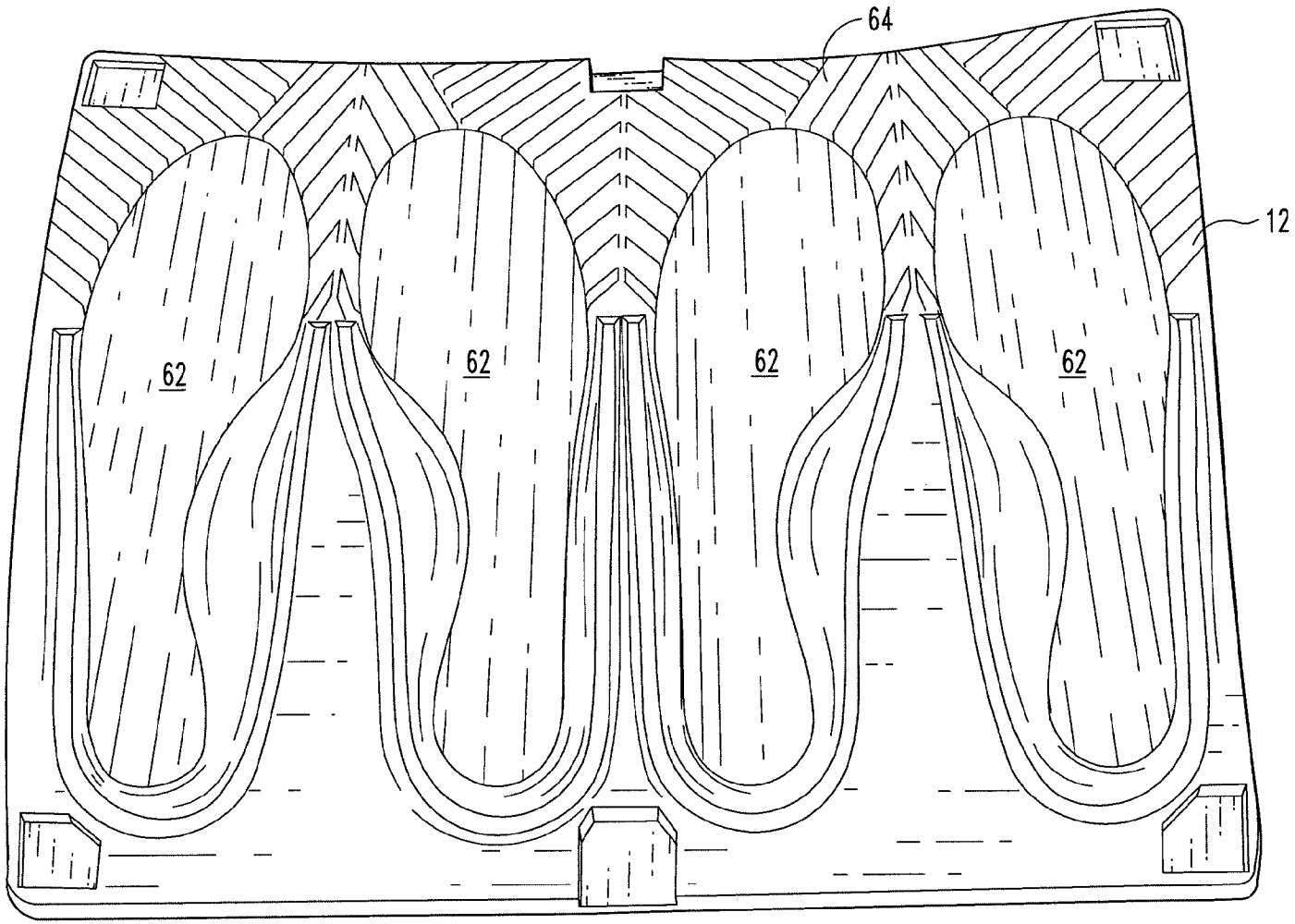
FIG. 9 is a perspective view illustrating a blocker of the thermoformable material layer from FIG. 7 having a cavity that has been created by the weighted unit of FIG. 6.
Figure 10:
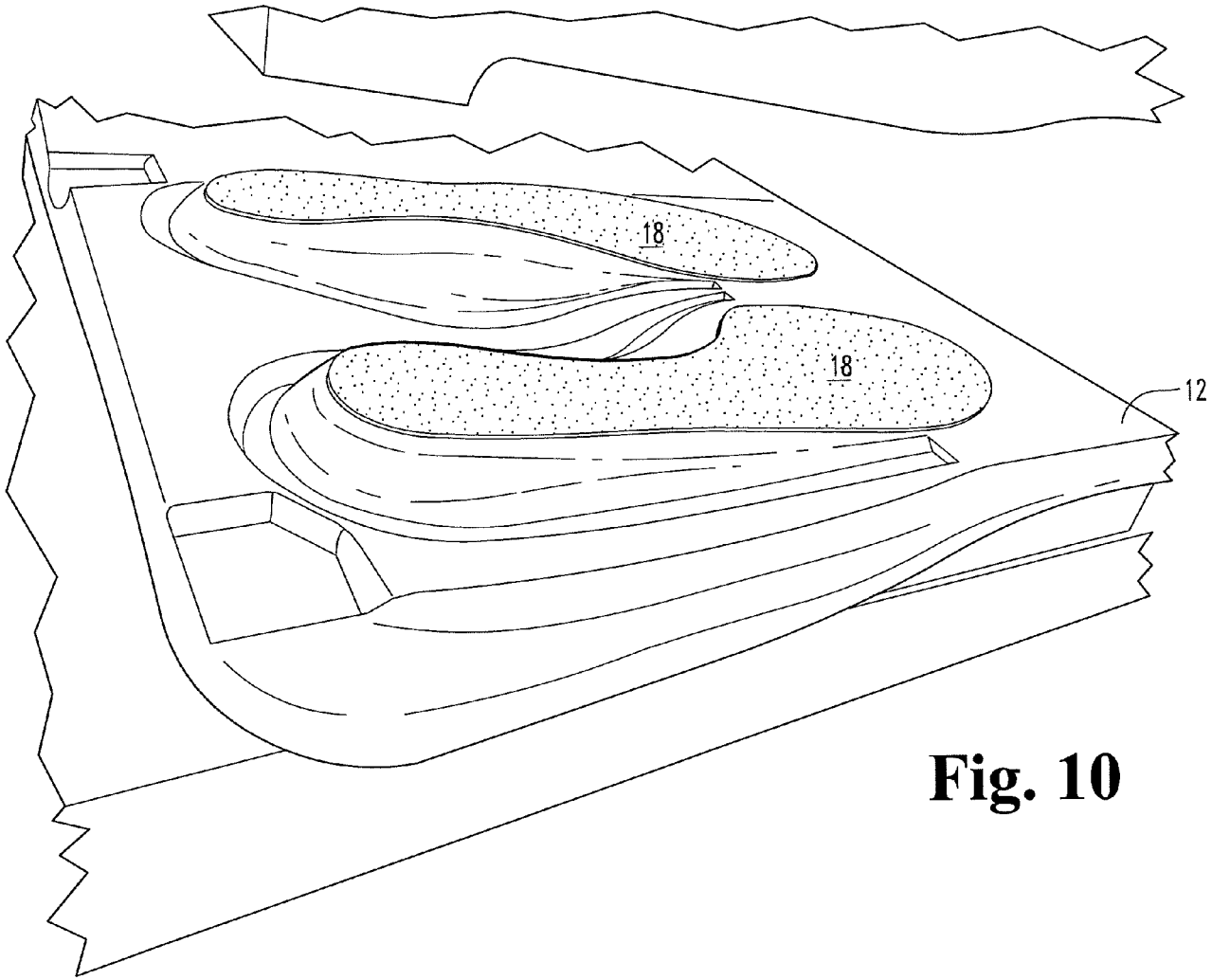
FIG. 10 is a fragmentary perspective view illustrating a weighted unit that has been placed in the molded cavity of the thermoformable material layer of FIG. 9.

After the thermoformable top layer 12 is subjected to the heat molding process, a cavity 62 reflecting the shape and dimensional characteristics of the weighted unit 18 is created in the bottom surface 64 of the layer 12 from coming into heated contact with such unit. FIG. 9 depicts an illustration of this cavity. In accordance with certain illustrative aspects of the present invention, the thermoforable top layer 12 is subjected to a temperature of about 120° C. for about 60 seconds.

Figure 11:
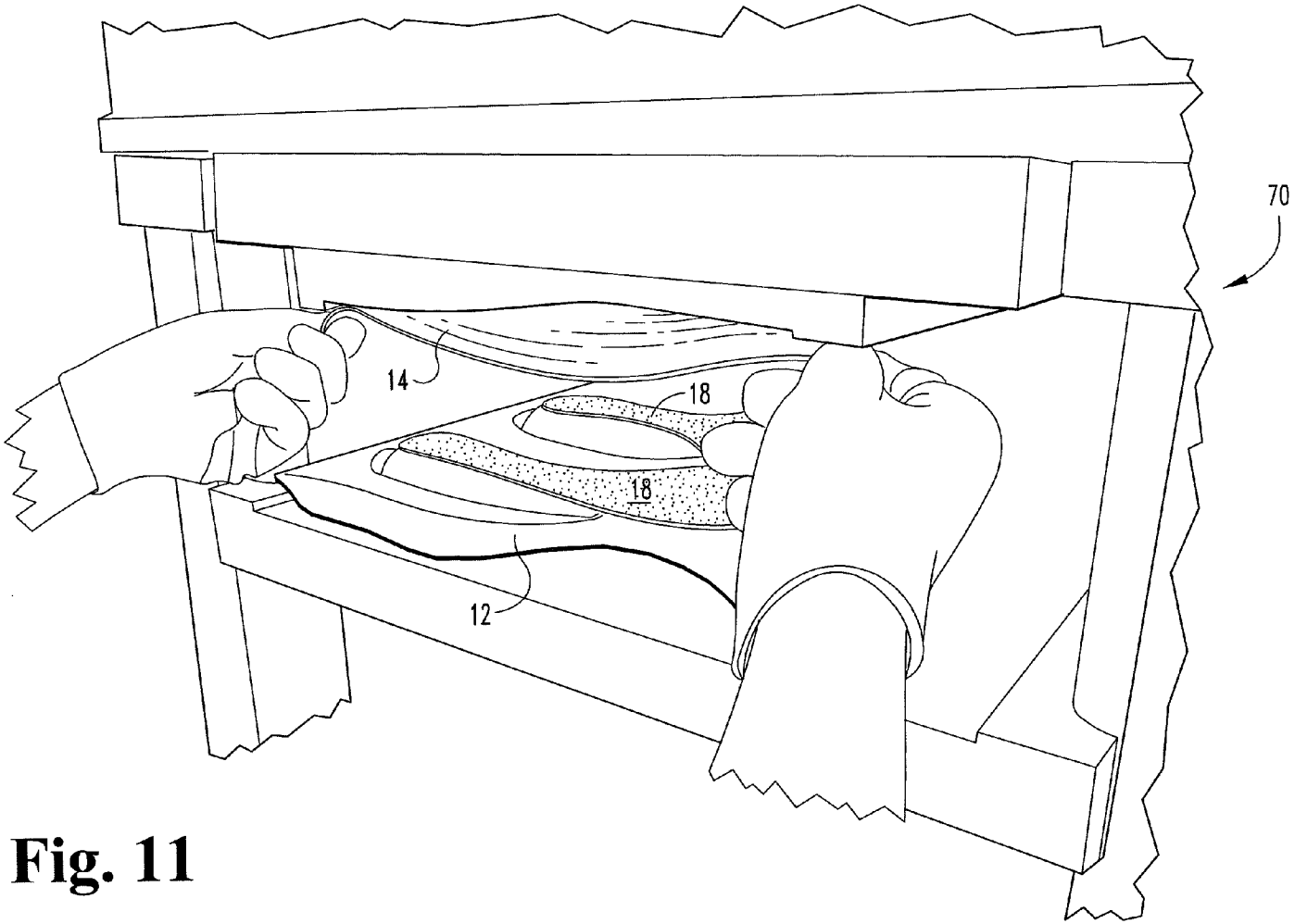
FIG. 11 is a fragmentary perspective view illustrating the weighted unit and thermoformable material layer placed in a mold together with a stiff thermoforable bottom layer in accordance with the teachings of the present invention.

Once the cavity 62 has been created in the thermoforable top layer 12, the weighted unit 18 is inserted into the cavity 62 (FIG. 10), and then both components together are placed into the mold 70 along with the thermoforable bottom layer 14 (FIG. 11). While not required, in accordance with certain aspects of the present invention, the thermoforable bottom layer 14 may also contain a cavity matching the cavity 62 of the top layer 62 to further hold the weighted unit 18 in position during the molding process.

Figure 12:
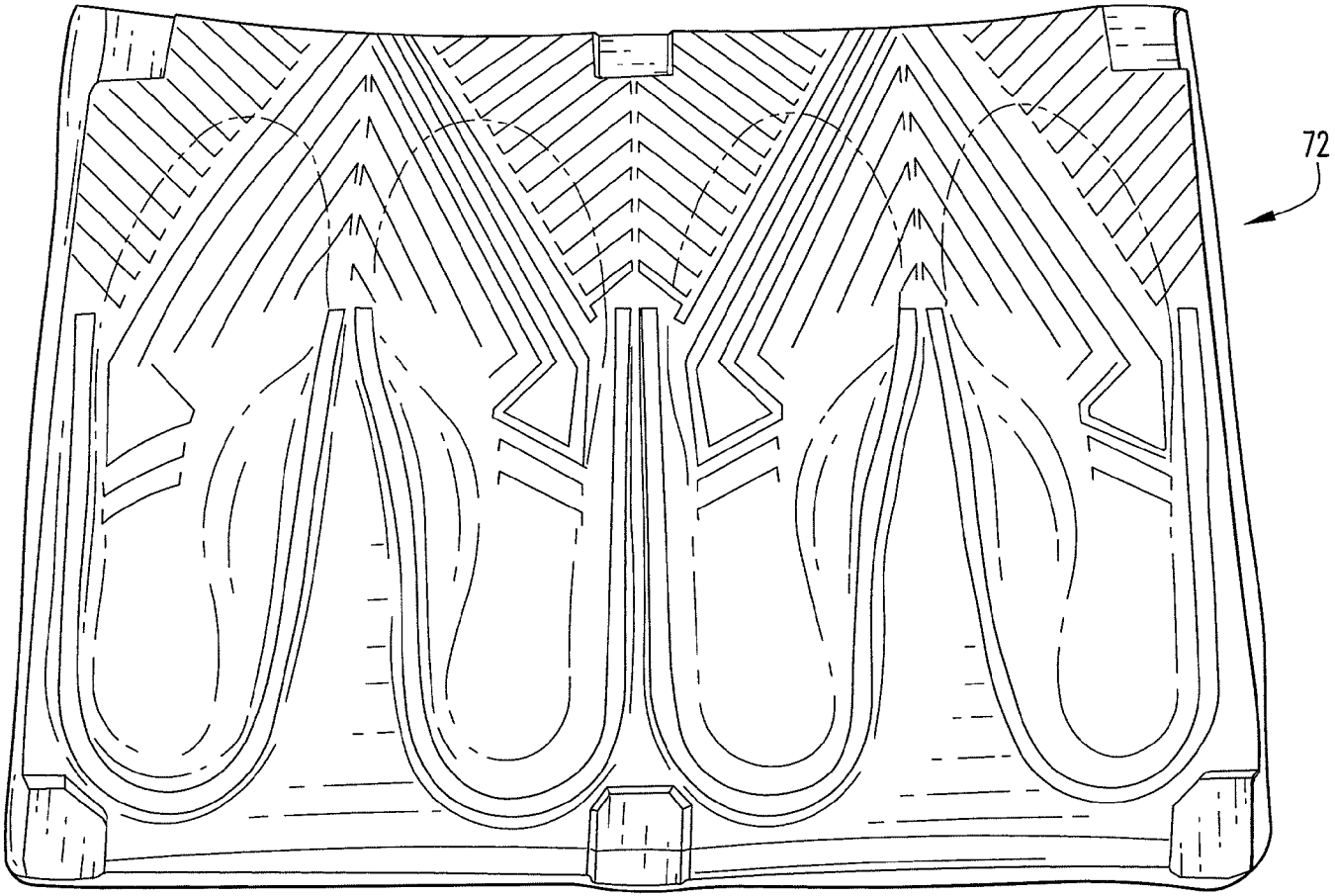
FIG. 12 is a perspective view illustrating a weighted insole assembly that has been molded in accordance with the teachings of the present invention.
Figure 13:
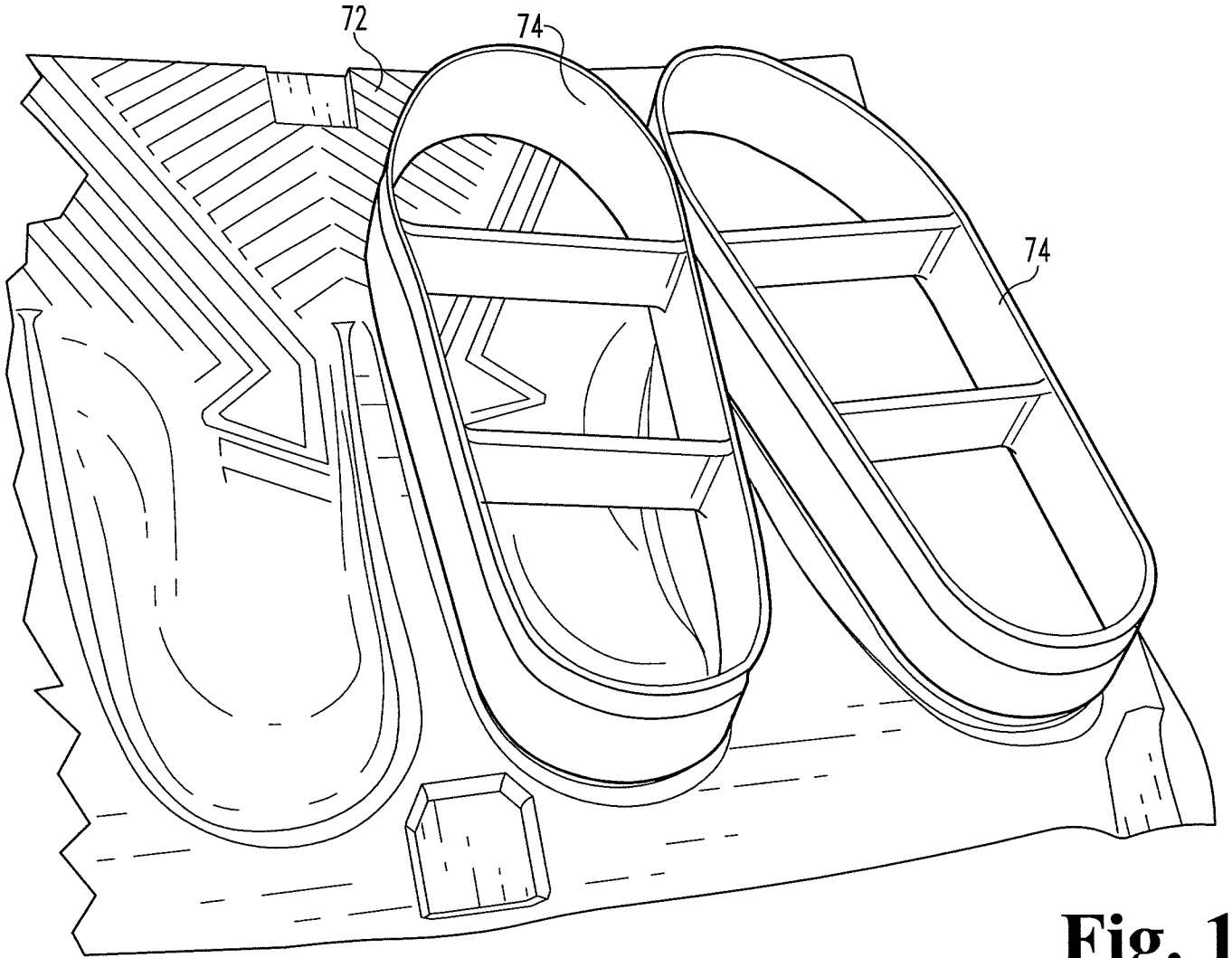
FIG. 13 is a fragmentary perspective view of the weighted insole assembly of FIG. 12 undergoing a die cutting process.

The top layer 12 and the bottom layer 14 are then laminated together under conditions of heat and pressure to fully encapsulate the weighted unit 18. FIG. 12 shows an exemplary illustration of weighted insole assembly blockers 72 that has been molded in accordance with the teachings of the present invention. The weighted insole assembly blockers 72 are then heated so that the materials soften and the blockers 72 placed in the mold for shaping. The mold is closed and the materials eventually cool and take the shape of the mold. After the blockers 72 are taken out of the mold, a die 74 is used to cut the material into the final insole products (FIG. 13).

In accordance with certain aspects of the present invention, it is envisioned that the weighted insole assemblies can be manufactured and sold as insole assembly training kits. In particular, it is envisioned that the kit can include both a pair of weighted insole assemblies, as well as standard insoles without the weighted portion encapsulated therein (i.e., non-weighted insoles). Depending on whether the end user is training or performing within a non-training or competitive session, the user can then switch out the insoles as desired to fit the specific activity at hand without losing the insole's supportive qualities. Instructional materials such as brochures, pamphlets and or DVDs can be provided to instruct a user as to the use of and training with the kits. It should be understood and appreciated herein that the standard insoles (i.e., those not including the weighted unit) can be manufactured with the same materials described herein, yet the weighted unit is eliminated from the manufacturing process.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for fabricating a weighted insole assembly, the method comprising:

creating a cavity in a first thermoformable material layer;

inserting a weighted unit in the cavity of the first thermoformable material layer;

placing the thermoformable material layer and the weighted unit into a mold;

introducing a second thermoformable material layer into the mold;

encapsulating the weighted unit between the first thermoformable material layer and the second thermoformable material layer by heating the mold and applying pressure;

removing a weighted insole assembly blocker from the mold; and cutting the weighted insole assembly blocker.

2. The method of claim 1, further comprising attaching a fabric layer.

3. The method of claim 2, wherein the fabric layer includes an agent configured to inhibit bacterial, microbial or fungal growth, the agent being selected from at least one of antimicrobial polymerizable compositions containing an ethylenically unsaturated monomer, di-functional or tri-functional antimicrobial monomers and polymerization initiators, silver containing antimicrobial agents comprising carboxymethylcellulose, crosslinked compounds containing silver or silver salts of carboxymethylcellulose, organic solvent-soluble mucopolysaccharides consisting of ionic complexes of at least one mucopolysaccharide and a quaternary phosphonium, antibacterial antithrombogenic compositions comprising organic solvent-soluble mucopolysaccharides and organic polymeric materials, antibacterial antithrombogenic compositions comprising organic solvent-soluble mucopolysaccharides and inorganic antibacterial agents, and silver, copper or zinc components.

4. The method of claim 1, wherein the first thermoformable material layer is fabricated from at least one of a thermoplastic synthetic resin foam, a thermosetting resin foam and a rubber material foam.

5. The method of claim 4, wherein the thermoplastic synthetic resin foam is selected from at least one of an ethylene-vinyl acetate copolymer and a cross-linked polyethylene.

6. The method of claim 4, wherein the thermosetting resin foam is polyurethane.

7. The method of claim 4, wherein the rubber material foam is selected from at least one of a butadiene rubber and a chloroprene rubber.

8. The method of claim 1, wherein the weighted unit includes a heavy filler material that includes at least one of copper oxide, zinc oxide, calcium oxide, lead oxide, tin oxide, antimony oxide, iron oxide, copper carbonate, magnesium carbonate, calcium carbonate, barium carbonate, zinc carbonate, cadmium carbonate, copper sulfide, barium sulfide, zinc sulfide, cadmium sulfide, iron sulfide, cobalt sulfide, lead sulfide, copper hydroxide, magnesium hydroxide, calcium hydroxide, barium hydroxide, aluminum hydroxide, cobalt hydroxide and lead hydroxide.

9. The method of claim 1, wherein the specific gravity of the weighted unit is between about 2.0 and about 4.0.

10. The method of claim 1, wherein the specific gravity of the weighted unit is between about 2.5 and about 3.5.

11. The method of claim 1, wherein the specific gravity of the weighted unit is between about 2.7 and about 3.2.

12. The method of claim 1, wherein the second thermoformable material layer is fabricated from an elastomeric material selected from one or more of natural rubbers, synthetic polyisoprenes, butyl rubbers, halogenated butyl rubbers, polybutadienes, styrene-butadiene rubbers, nitrile rubbers, hydrogenated nitrile rubbers, chloroprene rubbers, polychloroprenes, neoprene, baypren, ethylene propylene rubbers, copolymers of ethylene and propylene, ethylene propylene diene rubbers, terpolymers of ethylene, propylene and a diene-component), epichlorohydrin rubbers, polyacrylic rubbers, silicone rubbers, fluorosilicone Rubbers, fluoroelastomers, perfluoroelastomers, polyether block amides, chlorosulfonated polyethylenes and ethylene-vinyl acetate copolymers.

13. The method of claim 1, wherein the first thermoformable material layer has a durometer hardness of from about 30 Shore C to about 70 Shore C.

14. The method of claim 1, wherein the second thermoformable material layer has a durometer hardness of from about 60 Shore C to about 90 Shore C.

15. The method of claim 1, wherein the second thermoformable material layer has a durometer hardness of from about 70 Shore C to about 80 Shore C.

* * * * *